US006266884B1

(12) United States Patent
Prochaska

(10) Patent No.: US 6,266,884 B1
(45) **Date of Patent: *Jul. 31, 2001**

(54) TRIPLE BLADE SAFETY RAZOR

(75) Inventor: Frank Prochaska, Waynesboro, VA (US)

(73) Assignee: American Safety Razor Company, Verona, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/243,485

(22) Filed: Feb. 3, 1999

Related U.S. Application Data

(63) Continuation-in-part of application No. 09/059,289, filed on Apr. 14, 1998.
(60) Provisional application No. 60/080,316, filed on Apr. 1, 1998.

(51) Int. Cl.[7] ..... B26B 21/00
(52) U.S. Cl. ..... 30/50; 30/57; 30/346.57
(58) Field of Search ..... 30/47, 48, 49, 30/50, 57, 346.5, 346.57

(56) References Cited

U.S. PATENT DOCUMENTS 3,786,563 * 1/1974 Dorion, Jr. et al. ..... 30/50
3,861,040 * 1/1975 Dorion, Jr. ..... 30/50 X
4,407,067 * 10/1983 Trotta ..... 30/50
5,426,851 * 6/1995 Gilder et al. ..... 30/50
5,666,729 * 9/1997 Ferraro ..... 30/50

FOREIGN PATENT DOCUMENTS

WO 92/17322 * 10/1992 (WO) ..... 30/50
WO 95/09071 4/1995 (WO) .

* cited by examiner

*Primary Examiner*—M. Rachuba
(74) *Attorney, Agent, or Firm*—McDermott, Will & Emery

(57) ABSTRACT

A blade cartridge including three or more blades fixed between a platform member and a cap member. The present invention provides improved triple blade geometry where five contact surfaces with the skin are considered, including the edges of each of the blades, a skin contacting surface on the guard member and a skin contacting surface on the cap member. The five contacting surfaces are oriented at an equal distance from a common axis in order to ensure that the shaving forces normal to the contacting surfaces are shared by all of the contacting surfaces. The arrangement of the present invention provides optimal blade geometry, thereby producing a close and comfortable shave. Additionally, the blades of the present invention are movable to a less aggressive position in response to applied shaving forces.

6 Claims, 3 Drawing Sheets

TRIPLE BLADE SAFETY RAZOR

The present application is a continuation-in-part of U.S. patent application Ser. No. 09/059,289, filed on Apr. 14, 1998, which claims priority from Provisional Application No. 60/080,316, filed Apr. 1, 1998 pending.

BACKGROUND OF THE INVENTION

The present invention relates to wet shaving systems of the blade type and more particularly to a shaving system having three or more movable blades positioned within a blade cartridge.

Shavers have long sought a smooth and close shave. In the pursuit to develop the ideal shaving implement, razor blade cartridges have been developed that include three blades. The triple blade configuration gives a closer shave than conventional dual blade configurations because three cutting edges are used rather than two cutting edges. However, the development of a triple blade cartridge raises the issue of proper orientation of the three blades to optimize razor performance.

A triple blade razor includes a minimum of five contact points that must be considered in order to optimize razor performance. Clearly, the cutting edge of each blade must be considered, but also a skin-contacting surface of a cap member and a skin-contacting surface of a guard member must be considered. Ideally, the shaving forces normal to the contacting surfaces are shared by all of the contacting surfaces, thereby distributing the shaving forces and preventing excessive scraping or nicking by one of the blade edges. The amount shaving forces on each edge is determined by the degree of blade exposure given to that blade. Consequently, the degree of "blade exposure" is crucial to optimizing razor performance.

The term "blade exposure" represents a geometrical relationship between the blades and other skin-engaging surfaces of the blade cartridge. The term "blade exposure" means the distance by which the blade edge projects forwardly of a shaving plane. The "shaving plane" is the plane tangent to skin-engaging surfaces, referred to as the guard member and the cap member, which are disposed on both sides of the blades so as to engage the shaving surface before and after engagement by the blade.

Triple blade razors have been developed that are concerned with proper blade exposure, for example, PCT International Publication Number WO 95/09071, published on Apr. 6, 1995, describes a razor blade unit including three blades mounted within a housing. The razor blade unit includes a guard, a cap, and three blades with parallel sharpened edges located between the guard and the cap. The leading blade has an exposure of less than or equal to zero, the trailing blade has an exposure of greater than or equal to zero, and the exposure of the middle blade is not less than the exposure of the leading blade and not greater than the exposure of the trailing blade. The preferred embodiment of the razor blade described in the WO 95/09071 publication has a progressive increase in blade exposure from the leading blade to the trailing blade, thereby reducing drag forces placed on the blade unit as it is moved over the skin of the shaver.

In the aforementioned patent, the first blade is restricted to an exposure of less than or equal to zero. The restriction of the first blade to a negative exposure or an exposure equal to zero significantly reduces the effectiveness of the first blade to give a close shave. The exposure of the first blade as set forth in the WO 95/09071 publication severely limits the ability of the edge of the first blade to contact the skin of the shaver and cut the hair close to the skin. Overall the invention described in the WO 95/09071 publication fails to achieve optimal blade geometry based on the lack of sufficient positive blade exposure.

In addition to the amount of blade exposure of the blades, a second factor in constructing a wet shaving system that provides a smooth and comfortable shave without having annoying cuts and abrasions is the "shaving angle" of the blades in response to shaving forces. The term "shaving angle" is defined as the acute angle between a plane tangent to the cutting edge of the blade and the shaving plane.

Consequently, a need exists for a triple blade cartridge incorporating optimal blade geometry wherein the shaving forces normal to the contacting surfaces is shared by all of the contacting surfaces to provide a close and comfortable shave. Such a blade cartridge should take into account such factors as proper blade exposure, and shaving angle of the blades in response to shaving forces.

SUMMARY OF THE INVENTION

The present invention provides a novel blade cartridge designed to satisfy the aforementioned needs. A novel feature of the present invention is the development of improved triple blade geometry. In order to develop proper triple blade shaving geometry, five contact points or surfaces with the skin must be considered, which includes the edges of each of the three blades, a skin contacting surface on the guard member and a skin contacting surface on the cap member.

In order to optimize comfort and closeness of a shave, the shaving forces normal to the contacting surfaces should be shared by all five contacting surfaces. This is accomplished by orienting each of the five contacting surfaces at an equal distance from a common axis. In an alternate embodiment of the present invention, the blade cartridge includes more than three blades arranged in a similar manner with all of the contacting surfaces oriented at an equal distance from a common axis.

Accordingly, the present invention relates to a blade cartridge including a platform member having a guard member. The guard member is located on the front side of the platform member so as to form a longitudinal slot between the main portion of the platform member and the guard member. The blade cartridge also includes a primary blade that is disposed on the platform member such that the cutting edge of the blade is located rearwardly of the guard member. Preferably, the cutting edge of the primary blade is parallel to the guard member. A first contact surface is located on the guard member near the first blade and a second contact surface is located on the cutting edge of the first blade.

The blade cartridge also includes a spacer that is located on the primary blade. The spacer includes a rear portion that functions to separate the primary blade and a secondary blade.

The blade cartridge further includes a secondary blade that is disposed on the spacer such that the cutting edge of the blade is located rearwardly of the cutting edge of the primary blade. Preferably, the cutting edge of the secondary blade is parallel to the cutting edge of the primary blade. A third contact surface is located on the cutting edge of the second blade.

The blade cartridge also includes a spacer that is located on the secondary blade. The spacer includes a rear portion that functions to separate the secondary blade and a tertiary blade.

The blade cartridge further includes a tertiary blade that is disposed on the spacer such that the cutting edge of the blade is located rearwardly of the cutting edge of the secondary blade. Preferably, the cutting edge of the tertiary blade is parallel to the cutting edge of the secondary blade. A fourth contact surface is located on the cutting edge of the third blade.

The blade cartridge also includes a cap member disposed on the tertiary blade. The cap member secures the members forming the blade cartridge together. A fifth contact surface is located at a tangent point of contact with the cap member. The blade cartridge further includes a lubrication strip on the cap member.

Each blade of the present invention has a fixed end and a free, or cantilevered, end. The free end of each blade functions as a single cantilever forming a "flexing zone" about which the cutting edge of the blade bends in response to an applied force. Each blade is independently movable in response to shaving forces applied to the blade. Specifically, each blade is flexible about the longitudinal axis of the blade within a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade flexes about the longitudinal axis so as to bend in the downward direction against the resilient force of the blade. The bending movement of the blade results in the simultaneously decrease of blade exposure and shaving angle.

Preferably, the blade cartridge is connected to a handle, and can be pivotally connected so as to allow the blade cartridge to further respond to shaving forces encountered during the shaving process and orient itself optimally to the surface being shaved.

In order to optimize the comfort to the shaver by reducing irritation caused by the blades, the blade exposure of each of the blades is preferably made equal, thereby equally distributing the exposure of the blades over the skin of the shaver. In the preferred embodiment the blade exposure of each of the blades is 0.0005 inches.

The invention itself, together with further objects and advantages, will best be understood by reference to the following detailed description taken in conjunction with the accompanying drawings.

BRIEF DESCRIPTION OF THE DRAWINGS

FIGS. 1 though 3 are presented by way of illustration and not limitation to depict the preferred embodiments of the present invention. Embodiments including the various aspects of the present invention will now be described in detail with reference to the accompanying drawings.

DETAILED DESCRIPTION OF THE INVENTION

Figure 1:
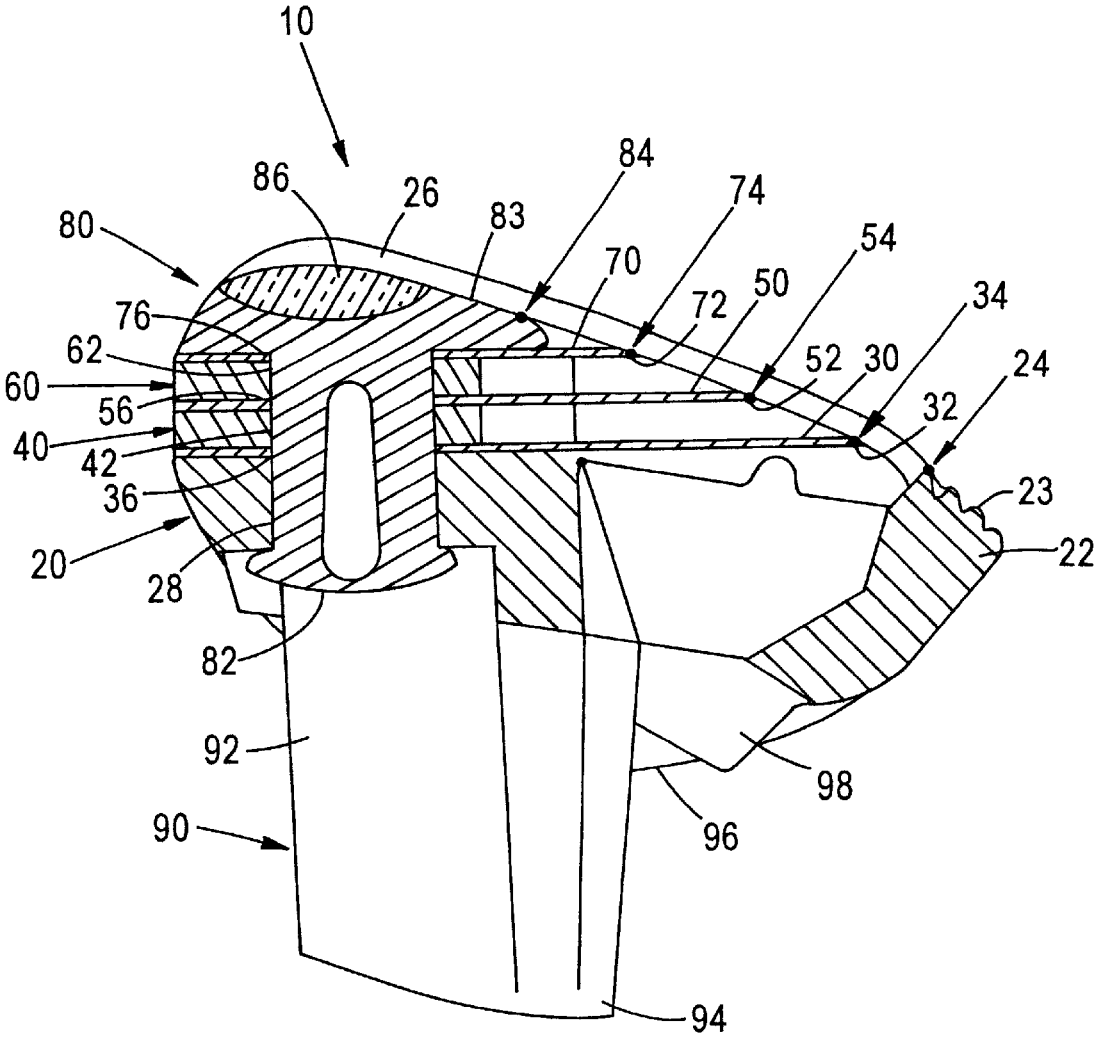
FIG. 1 is a cross-sectional view of the razor blade cartridge of the present invention through a rivet on the cap member.
Figure 3:
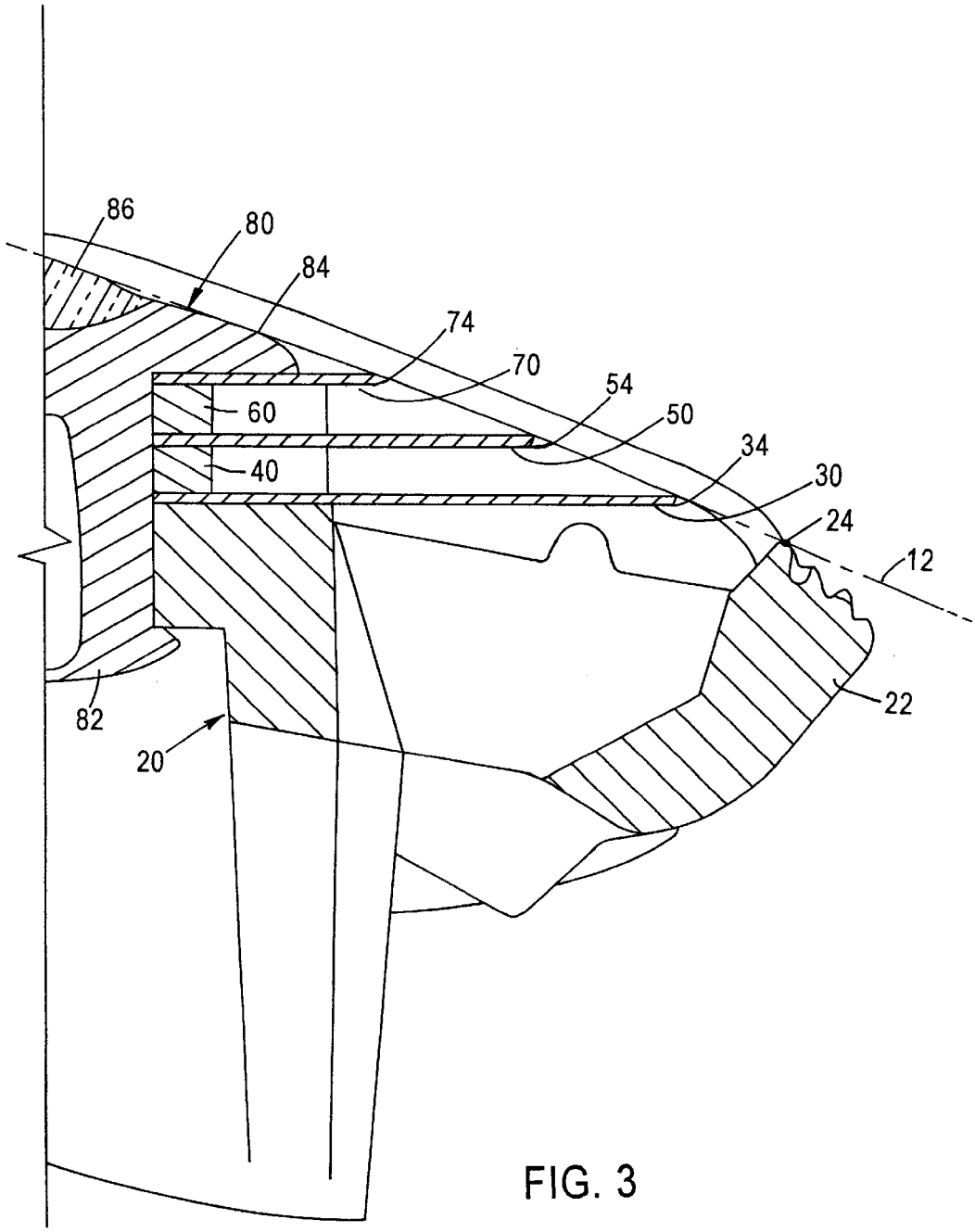
FIG. 3 is an enlarged, cross-sectional view of the razor blade cartridge of the present invention.

Turning now to the drawings, FIGS. 1 and 3 illustrate a triple blade shaving cartridge or razor head 10 which comprises a platform member 20, primary blade 30, first spacer 40, secondary blade 50, second spacer 60, tertiary blade 70, and a cap member 80.

As depicted in FIG. 1, the platform member 20 includes a guard member 22 positioned at the front of the blade cartridge 10. The guard member 22 is positioned in front of the first blade 30 and is preferably integral with the platform member 20, and therefore, stationary relative to the blade cartridge 10. The guard 22 being positioned in front of the first blade 30 has a raised skin engaging portion 23, which provides an engaging surface to control exposure of the first blade 30 to the shaver's skin. The guard member 22 extends parallel to the first blade 30.

The platform member 20 includes a plurality of securing apertures 28. The securing apertures 28 operate in conjunction with staking pins (or rivets) 82 located on the cap member 80 to permanently secure the platform member 20, the blades 30, 50, and 70, the spacers 40 and 60, and the cap member 80 together.

The blade cartridge 10 includes a primary or first blade 30, a secondary or second blade 50, and a tertiary or third blade 70, each having substantially parallel front and rear edges with the front edge of each blade defining a skin-engaging edge or cutting edge 32, 52, and 72. Each blade 30, 50, and 70, defines a longitudinal axis that is parallel to the cutting edge of the blade 30, 50, and 70, and a lateral axis that is perpendicular to the cutting edge of the blade 30, 50, and 70. Preferably, each blade 30, 50, and 70 is flexible about its longitudinal axis.

As described hereinafter, each blade if so desired may be mounted with a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade will therefore flex about the longitudinal axis so as to bend in the downward direction against the resilient force of the blade, placing the blades in a loaded position. The bending movement of the blade results in the simultaneously decrease of blade exposure and shaving angle, thereby moving the blade to a less aggressive position in response to applied shaving forces. The resiliency of the blades returns the blades to the normal, unloaded, horizontal position (as depicted in FIG. 1) upon removal of the applied shaving force. The flexibility of each blade depends upon factors including (1) the amount of overhang of the cutting edge (the distance the blade extends beyond the surface beneath the lower surface of the blade), (2) the thickness of the blade, and (3) the dimensions of the various apertures in the blades. These factors can be adjusted so that the blades 30, 50, and 70 flex when the applied force exceeds a predetermined level.

As depicted in FIG. 1, the first blade 30 includes securing apertures 36 which align with the securing apertures 28 of the platform member 20 so as to allow the staking pins 82 to pass through the securing apertures 36 of the first blade 30, thereby securing the first blade 30 to the blade cartridge 10. The rear of the first blade 30 is fixed between the platform member 30 and the spacer 40.

The spacer 40 functions to separate blades 30 and 50. As depicted in FIG. 1, the spacer 40 includes securing apertures 42 which align with the securing apertures 28 of the platform member 20 so as to allow the staking pins 82 to pass through the securing apertures 42 of the spacer 40, thereby securing the spacer 40 to the blade cartridge 10.

The second blade 50, as depicted in FIG. 1, includes securing apertures 56 which align with the securing apertures 28 of the platform member 20 so as to allow the staking pins 82 to pass through the securing apertures 56 of the second blade 50, thereby securing the blade to the blade cartridge 10. The rear of the second blade 50 is fixed between the spacer 40 and the spacer 60.

The spacer 60 functions to separate blades 50 and 70. As depicted in FIG. 1, the spacer 60 includes securing apertures 62 which align with the securing apertures 28 of the platform member 20 so as to allow the staking pins 82 to pass through the securing apertures 62 of the spacer 60, thereby securing the spacer 60 to the blade cartridge 10.

The third blade 70, as depicted in FIG. 1, includes securing apertures 76 which align with the securing apertures 28 of the platform member 20 so as to allow the staking pins 82 to pass through the securing apertures 76 of the third blade 70, thereby securing the blade to the blade cartridge 10. The rear fixed between the spacer 60 and the cap member 80.

In the preferred embodiment, the spacers 40 and 60 exhibit a uniform height so that when the blades 30, 50 and 70 are secured to the blade cartridge 10 the blades 30, 50, and 70 are parallel to one another.

FIG. 1 illustrates the alignment of the first blade 30, the spacer 40, the second blade 50, the spacer 60, and the third blade 70. As depicted the cutting edge 32 of the first blade 30 is located forward of the cutting edge 52 of the second blade 50 which is located forward of the cutting edge 72 of the third blade 70.

An embodiment of the cap member 80 of the present invention is illustrated in FIG. 1. The cap member 80 is disposed on the third blade 70 with an upper surface 83 of the cap member 80 having a skin-engaging surface or contact surface 84 thereon. The entire upper surface 83 of the cap member 80 may act as a skin-engaging surface, however, as will be explained in detail below, contact surface 84 is the surface that determines the amount of exposure of the third blade 70. The cap member 80 includes a plurality of staking pins 82, such as rivets. The ends of the staking pins 82 extend beyond the securing apertures 28 of the platform member 20 and are upset thereby permanently affixing the platform member 20, blades 30, 50, and 70, spacers 40 and 60, and cap member 80 together.

In order to prevent the corners of the blades 30, 50, and 70 from engaging the skin of the user, end clips 26 cover the outer edges of the first, second, and third blades 30, 50, and 70. As depicted in FIG. 1, each end clip 26 is located over the ends of the cap member 80. The end clips 26 are either integrally molded with the cap member 80 or they are preferably separate pieces affixed to the cap member 80 and blade cartridge 10.

As a result of mounting the blades 30, 50, and 70 in accordance with the present invention, there is no longitudinal movement of any of the blades 30, 50, and 70 relative to the remainder of the blade cartridge 10. Only rotational movement about the longitudinal axis associated with the each blade 30, 50, and 70 is possible, if so desired by constructing with sufficient overhang. Furthermore, the blades 30, 50, and 70 flex independently of one another. For example, if the pressure encountered by the first blade 30 exceeds the resilient force of the first blade 30, the first blade 30 bends in response to that force. Specifically, the first blade 30 bends about the longitudinal axis thereof, thereby causing the cutting edge 32 to move in a downward manner Upon removal of the force, the first blade 30 would return to the horizontal position as depicted in FIG. 1. If an equivalent force were applied to either the second blade 50 or the third blade 70, they would respond in a similar manner. Thus, the cutting edges 32, 52, and 72 of the blades 30, 50, and 70 move downwardly away from the shaving plane and adjust to a lower, safer shaving angle and blade exposure.

Numerous variations of the blades 30, 50, and 70 are possible to further enhance the flexibility of the blades. For example, each blade 30, 50, and 70 may be tapered such that the thickness of the blade decreases in the direction of the forward portion of the blade. Also, each blade 30, 50, and 70 can comprise a U-shaped channel in the front portion of the blades, which functions to define flexing zones for the blade 30, 50, and 70. Finally, holes can be added to the blades of the preferred embodiment to vary the flexibility of the blades 30, 50, and 70.

In yet another variation, a shaving aid or lubrication applicator 86 may be affixed or included with the blade cartridge 10. Typically, as depicted in FIG. 1, the shaving aid 86 comprises a polystyrene-polyethylene oxide blend in the form of lubricating strip, which may affixed to the upper surface 83 of the cap member 80 behind the third blade 70. During shaving, the polyethylene oxide bleaches out of the styrene matrix. The cap member 80 may have a molded lube strip glued on or the lube strip may be molded onto the cap member 80 in a second shot. Preferably, the shaving aid 86 comprises a matrix of polystyrene, polyethylene oxide and aloe and/or vitamin E.

In yet a further variation, the blade cartridge 10 may be permanently or detachably connected to a handle by suitable structures formed on the bottom surface of the blade cartridge 10. Alternatively, the blade cartridge 10 can be mounted on a handle in such a manner that it pivots or is stationary while it is used to shave a surface. For example, as illustrated in FIG. 1, the bottom surface of the platform member 20 includes a mounting device 90 that allow the blade cartridge 10 to be pivotally and detachably mounted to a handle. The mounting device 90 includes a pair of mounting members 92 with attaching hooks 94 on the terminal end thereof. The mounting device 90 further includes an arcuate pivot rail 96 and a centering cam 98.

A novel feature of the present invention is the development of improved triple blade geometry. In order to develop proper triple blade shaving geometry, five contact points with the skin must be considered. A first contact surface 24 is located on the guard member 22 near the first blade 30. A second contact surface 34 is located on the cutting edge 32 of the first blade 30. A third contact surface 54 is located on the cutting edge 52 of the second blade 50. A fourth contact surface 74 is located on the cutting edge 72 of the third blade 70. A fifth contact surface 84 is located at a tangent point of contact with the cap member 80.

Figure 2:
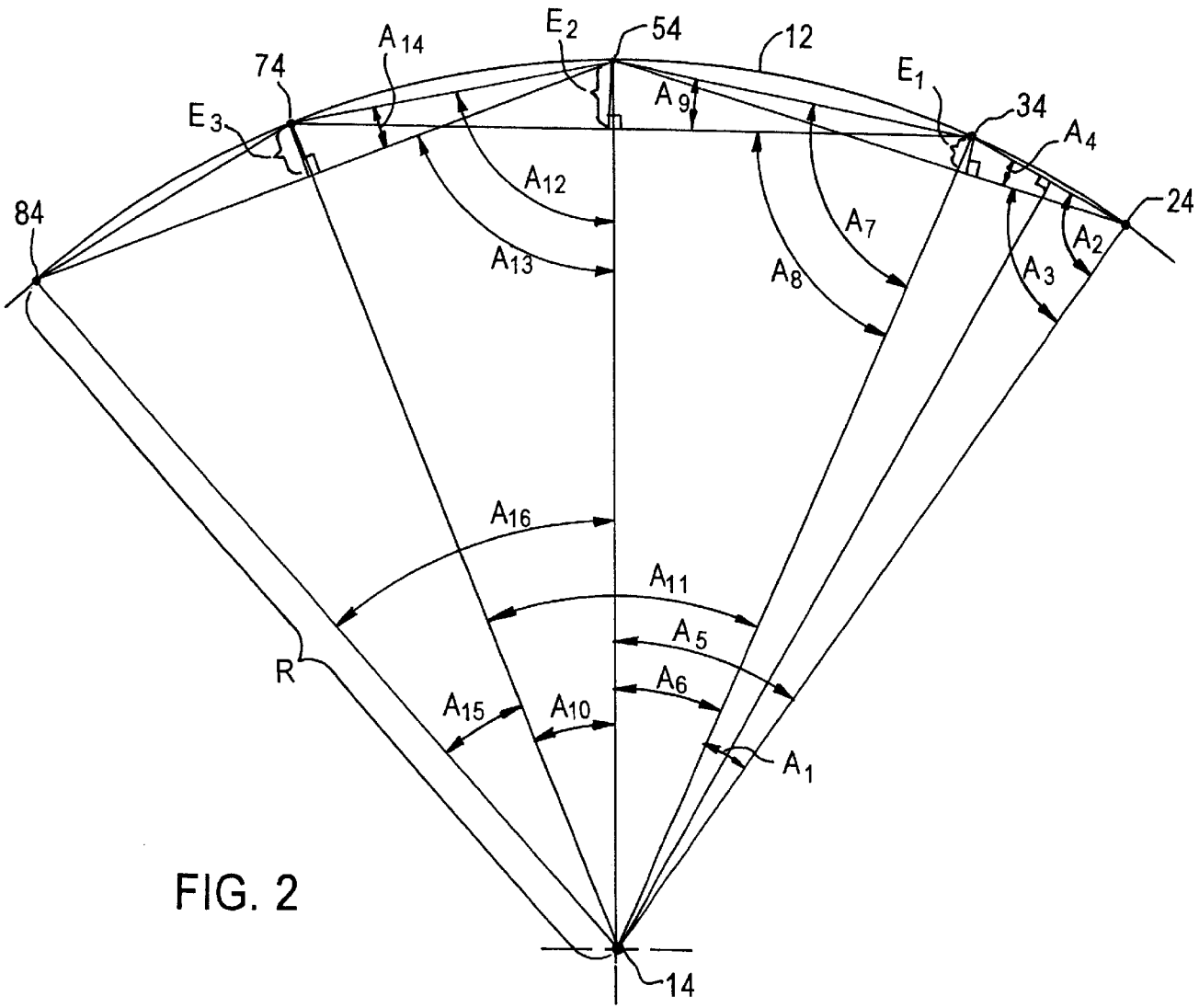
FIG. 2 is a schematic representation of a geometrical configuration used to calculate the exposure of the three blades of the present invention.

Experience with the movable triple blade cartridge has shown that comfort, closeness, and nicking results are optimized when the shaving forces normal to the contacting surfaces are shared by all five contacting surfaces, 24, 34, 54, 74, and 84. This is accomplished by orienting each of the five contacting surfaces, 24, 34, 54, 74, and 84, at an equal distance from a common axis 14 that is located at the rearward side of the blade cartridge 10, as depicted in FIGS. 2 and 3. In other words each of the five contacting surfaces, 24, 34, 54, 74, and 84, are positioned on a curve 12 that has a constant radius of curvature R. The common axis 14 is generally parallel to the contacting surfaces, 24, 34, 54, 74, and 84, of the blade cartridge 10.

FIG. 2 is a schematic representation of a geometrical configuration used to calculate the exposure, $E_1$, $E_2$, and $E_3$, of the three blades 30, 50, and 70, respectively. FIG. 2 is not drawn to scale. FIG. 2 is a two-dimensional representation of three dimensional objects or references, such as contact surfaces 24, 34, 54, 74, and 84, curve 12, and common axis 14.

With all of the contact surfaces, 24, 34, 54, 74, and 84, located at an equal distance from a common axis 14, the amount of blade exposure can be adjusted by varying the distance (or "span") between adjacent contact points. Another method of adjusting the blade exposure is to varying the height of the contacting surfaces relative to one another, for example making the contacting surface of one blade protrude further than the adjacent contact surfaces.

Although the present invention is not limited hereto, testing and design evaluation on the triple blade moving blade cartridge appears to favor an R distance value ranging from between 1.2 inches to 2.0 inches, with test data tending to support preferred values in the range of 1.5 inches to 1.7 inches.

Measurements made on test cartridges preferred by test shaves appear to favor distances or spans between adjacent contact surfaces ranging from about 0.025 inches to about 0.070 inches. The preferred span between the contact surface 24 on the guard member 20 and the contact surface 34 on the first blade 30 is about 0.034 inches. The preferred span between the contact surface 34 on the first blade 30 and the contact surface 54 on the second blade 50 is about 0.053 inches. The preferred span between the contact surface 54 on the second blade 50 and the contact surface 74 on the third blade 70 is about 0.056 inches. And finally, the preferred span between the contact surface 74 on the third blade 70 and the contact surface 84 on the cap member 80 is about 0.050 inches.

Measurements made on test cartridges preferred by test shaves appear to favor blade exposures ranging from about 0.0001 inches to about 0.0025 inches. In order to optimize the comfort to the shaver by reducing irritation caused by the blades, the blade exposures, $E_1$, $E_2$, and $E_3$, of each of the blades, 30, 50, and 70, respectively, are preferably made equal. In the preferred embodiment the blade exposures $E_1$, $E_2$, and $E_3$ are about 0.0005 inches.

If the span between the adjacent contact surfaces is selected and a value for R is selected, then FIG. 2 can be constructed to calculate the blade exposures, $E_1$, $E_2$, and $E_3$. For example, if a value for R of 1.5 inches is selected and the preferred span values are used, then the value of $E_1$ can be calculated using the following geometric equations:

$$\mathrm{Sin}\frac{A_1}{2} = \frac{\text{Span (24 to 34)}}{2R}$$

$$A_1 = 1.298732°$$

$$A_2 = \frac{180 - A_1}{2} = 89.350634°$$

$$\mathrm{Sin}\frac{A_6}{2} = \frac{\text{Span (34 to 54)}}{2R}$$

$$A_6 = 2.024556°$$

$$A_5 = A_1 + A_6 = 3.323288°$$

$$A_3 = \frac{180 - A_5}{2} = 88.338356°$$

$$A_4 = A_2 - A_3 = 1.012278°$$

-continued $$\mathrm{Sin}A_4 = \frac{E_1}{Span\ (24\ \text{to}\ 34)}$$

$$E_1 = \mathrm{Span}\,(24\ \text{to}\ 34)\,\mathrm{Sin}\,A_4$$

$$E_1 = 0.0006''$$

Similar calculations can be carried out to determine that $E_2$ is equal to 0.0010 inches and $E_3$ is equal to 0.0009 inches. If R is changed to 1.7 inches than $E_1$ equals 0.0005 inches, $E_2$ equals 0.0009 inches, and $E_3$ equals 0.0008 inches.

The positive exposure of each of the blades, 30, 50, and 70, ensures that each blade will share in the distribution of shaving forces normal to the contact surfaces, 24, 34, 54, 74, and 84, of the razor blade cartridge 10. This distribution of forces prevents any one blade edge from having an excessive force being placed thereon, which is likely to cause scraping or nicking of the shaver's skin. The positive exposure of each of the blades 30, 50, and 70, also allows the blade edges, 32, 52, and 72, to cut the hair close to the skin of the shaver, thereby giving a close shave.

FIG. 3 depicts an enlarged, cross-sectional view of the razor blade cartridge 10 according to the present invention. As depicted in FIG. 3, the contact surfaces 24, 34, 54, 74, and 84, are oriented along curve 12, which lies at a constant radial distance from a common axis (designated in FIG. 2 as reference numeral 14). The contact surfaces of interest in the present invention for the guard member 20 and the cap member 80 are the skin-engaging surfaces closest to their respective adjacent blades designated by reference numerals 24 and 84, respectively.

In an alternate embodiment of the present invention, the blade cartridge includes more than three blades arranged in a similar manner with all of the contacting surfaces oriented at an equal radial distance from a common axis 14.

The embodiments described above provide a number of significant advantages. The present invention provides a triple blade cartridge arrangement wherein all the skin contacting surfaces, 24, 34, 54, 74, and 84, share the shaving forces normal to the contacting surfaces to provide a close and comfortable shave. This is accomplished by orienting all of the contacting surfaces at an equal radial distance from a common axis 14. This arrangement is especially significant for optimizing the shaving performance of razor blade cartridges having three or more blades.

As yet another advantage, the blade cartridge of the present invention provides a blade that is flexible about the longitudinal axis of the blade within a body portion of a blade cartridge precisely controls blade geometry in response to shaving forces. Any flexing of the blade results in the simultaneous reduction of critical safety dimensions, blade exposure and shaving angle.

Of course, it should be understood that a wide range of changes and modifications could be made to the preferred embodiment described above. It is therefore intended that the present invention is not limited to the embodiments described above, but encompasses any and all embodiments within the scope of the following claims, and equivalents thereof.

What is claimed is:

1. A razor blade cartridge comprising a guard member, a cap member, and at least three blades mounted between said guard member and said cap member, wherein said guard member, said cap member, and said at least three blades each have a contact surface disposed along a curve having a radius of curvature measured from an axis extending in a direction parallel to said contact surfaces of said guard member, said cap member, and said at least three blades, wherein said at least three blades have an equivalent exposure.

2. The razor blade cartridge according to claim 1, wherein said equivalent exposure is about 0.0005 inches.

3. A razor blade cartridge comprising:

a platform member having a guard member with a skin-engaging surface t hereon;

a first blade mounted on said blade cartridge, said first blade having a cutting edge located rearwardly of said guard member;

a second blade mounted on said blade cartridge, said second blade having a cutting edge located rearwardly of said cutting edge of said first blade;

a third blade mounted on said blade cartridge, said third blade having a cutting edge located rearwardly of said cutting edge of said second blade; and a cap member connected to said platform member, said cap member having a skin-engaging surface located rearwardly of said cutting edge of said third blade, wherein said skin-engaging surface of said guard member, said cutting edge of said first blade, said cutting edge of said second blade, said cutting edge of said third blade, and said skin-engaging surface of said cap member are each disposed along a curve having a radius of curvature measured from an axis extending in a direction parallel to said skin-endaging surface of said guard member, said cutting edge of said first blade, said cutting edge of said second blade, said cutting edge of said third blade, and said skin-engaging surface of said cap member, and wherein said first blade, said second blade, and said third blade have an equivalent exposure.

4. The razor blade cartridge according to claim 3 wherein said equivalent exposure is about 0.0005 inches.

5. An apparatus for shaving comprising:

a handle; and a razor blade cartridge connected to the handle; wherein the razor blade cartridge comprises a guard member, a cap member, and at least three blades mounted between said guard member and said cap member, wherein said guard member, said cap member, and said at least three blades each have a contact surface disposed along a curve having a radius of curvature measured from an axis extending in a direction parallel to said contact surfaces of said guard member, said cap member, and said at least three blades, wherein said at least three blades have an equivalent exposure.

6. The apparatus of claim 5, further comprising:

a pivotable connection between the handle and the razor blade cartridge.

* * * * *